US009828983B2

(12) United States Patent
Chu

(10) Patent No.: US 9,828,983 B2
(45) Date of Patent: Nov. 28, 2017

(54) LINEAR PERISTALTIC PUMP FOR PRECISE AND QUANTITATIVE DELIVERY OF FLUID

(71) Applicant: CHANGZHOU PREFLUID TECHNOLOGY CO., LTD., Jiangsu (CN)

(72) Inventor: Jiangbo Chu, Jiangsu (CN)

(73) Assignee: CHANGZHOU PREFLUID TECHNOLOGY CO., LTD., Changzhou (CN)

( * ) Notice: Subject to any disclaimer, the term of this patent is extended or adjusted under 35 U.S.C. 154(b) by 257 days.

(21) Appl. No.: 14/440,224

(22) PCT Filed: Jul. 22, 2014

(86) PCT No.: PCT/CN2014/082729

§ 371 (c)(1),
(2) Date: May 1, 2015

(87) PCT Pub. No.: WO2015/067070

PCT Pub. Date: May 14, 2015

(65) Prior Publication Data

US 2016/0003230 A1 Jan. 7, 2016

(30) Foreign Application Priority Data

Nov. 7, 2013 (CN) ..... 2013 1 0549256

(51) Int. Cl.
*F04B 43/12* (2006.01)
*F04B 13/00* (2006.01)
*F04B 53/16* (2006.01)

(52) U.S. Cl.
CPC ..... *F04B 43/12* (2013.01); *F04B 13/00* (2013.01); *F04B 43/1223* (2013.01); *F04B 53/16* (2013.01)

(58) Field of Classification Search
CPC .. F04B 43/12; F04B 43/1215; F04B 43/1223; F04B 43/1238; F04B 13/00; F04B 45/08
(Continued)

(56) References Cited

U.S. PATENT DOCUMENTS 7,607,554 B2 10/2009 Hynes et al.
2012/0034105 A1 2/2012 Hillman

FOREIGN PATENT DOCUMENTS

CN 203161500 U * 8/2013
CN 103557114 A 2/2014
(Continued)

OTHER PUBLICATIONS

Oct. 13, 2014 Search Report issued in International Patent Application No. PCT/CN2014/082729.
(Continued)

*Primary Examiner* — Devon Kramer
*Assistant Examiner* — Kenneth J Hansen
(74) *Attorney, Agent, or Firm* — Oliff PLC

(57) ABSTRACT

The present invention refers to a peristaltic pump, especially refers to a linear peristaltic pump for precise and quantitative delivery of fluid, comprising a base, wherein, a lateral seat for fixing a flexible tube is provided on the base, a linear reciprocating movement mechanism is provided below the flexible tube; a sliding block is provided on the linear reciprocating movement mechanism, adapted for releasing and squeezing a flexible tube to moves up and down; a backflow preventing device is fixed on the base arranged close to the linear reciprocating movement mechanism. By adopting the above structure, a new operational principle of linear type is formed, and the structure of traditional rotary peristaltic pump is improved. The flexible tube is rarely abraded; it is easy to disassemble and assemble the flexible tube; and the feed liquid does not contact with the device.

9 Claims, 6 Drawing Sheets

(58) Field of Classification Search
USPC ..... 417/474–476, 477.3, 477.6, 477.8
See application file for complete search history.

(56) References Cited

FOREIGN PATENT DOCUMENTS

| | | | |
|---|---|---|---|
| CN | 203702512 | U | 7/2014 |
| JP | S59-166867 | A | 9/1984 |
| JP | S64-6378 | U | 1/1989 |
| JP | H04-259689 | A | 9/1992 |

OTHER PUBLICATIONS

Dec. 17, 2014 Office Action issued in Chinese Patent Application No. 201310549256.3.

* cited by examiner

LINEAR PERISTALTIC PUMP FOR PRECISE AND QUANTITATIVE DELIVERY OF FLUID

TECHNICAL FIELD

The present invention refers to a peristaltic pump, especially refers to a linear peristaltic pump for precise and quantitative delivery of fluid.

BACKGROUND OF THE INVENTION

A peristaltic pump functions like fingers holding a fluid filled tube. The fluid in the tube moves forward, as fingers slide forward. A peristaltic pump also adopts this principle by only replacing the fingers by a contact roller. The pump of fluid is achieved by alternately squeezing and releasing the flexible delivery tube of the pump. Like the fingers squeezing a flexible tube, with the movement of the fingers, a negative pressure is formed in the tube, therefore the fluid flows. A peristaltic pump is to form a "pillow" shaped fluid in the pump tube between two rolls. In industrial production, in many cases they need to add the liquid to the production apparatus by a peristaltic pump, so that the fluid may be remained in the flexible tube, or the speed of introducing fluid into the flexible tube is not fast enough. So that it is necessary to design an apparatus for squeezing the fluid in the flexible tube, on one hand, to increase the speed of introducing fluid into the flexible tube by alternately squeezing, on the other hand, to discharge the remaining fluid in the flexible tube by alternately squeezing, at the same time, the liquid delivery quantity can be accurate quantitative controlled.

Chinese patent CN 203161500 U discloses a linear peristaltic pump, comprising a frame, a lifting motion, an infusion set, an infusion flexible tube, a linear drive module, an on-off valve, and an extrusion roller assembly, wherein, the linear drive module is assembled on the frame, the infusion set is connected to the lifting motion, the on-off valve is fixed on the frame, the infusion flexible tube is assembled on the infusion set and passes through the on-off valve, the extrusion roller assembly is connected on the linear drive module. The invention increases the life time of the infusion flexible tube, occupied less space, and improves the accuracy of the delivery of fluid. But the accurate quantitative control of the liquid delivery quantity cannot be achieved by the invention, besides, the invention cannot prevent backflow very well.

SUMMARY OF THE INVENTION

The technical problem to be solved by the present invention is to provide a linear peristaltic pump for precise and quantitative delivery of fluid.

In order to solve the above mentioned technical problem, the present invention provides a linear peristaltic pump for precise and quantitative delivery of fluid, comprising a base, a lateral seat for fixing a flexible tube is provided on the base, a linear reciprocating movement mechanism is provided below the flexible tube;

a sliding rod base is provided on the linear reciprocating movement mechanism, a sliding rod base shaft is fixed on the sliding rod base, a sliding block is sleeved on the sliding rod base shaft; a pin roller is provided at the top end of the sliding block, adapted for squeezing a flexible tube to allow fluid in the tube to move forwards the pin roller, the pin roller is in contact with the flexible tube, a detection device for detecting a position of sliding rod base is provided on the base;

a guide rod parallel with the flexible tube is fixed on the lateral seat, a through hole adapted for coordinating with the guide rod is provided on the sliding block, the guide rod is arranged to extend through the through hole on the sliding block, and both ends of the guide rod are connected with a moving device for moving the sliding block up and down; a backflow preventing device is fixed on the base arranged close to the linear reciprocating movement mechanism.

Further, the linear reciprocating movement mechanism comprises a rotation motor fixed on the base; a rotation shaft of the rotation motor is in transmission connection with a guide screw through a shaft coupling, the guide screw is provided parallel with and below the guide rod; a nut adapted for moving in linear direction is provided on the guide screw, the nut is fixed to the sliding rod base.

Further, a guide screw cover is provided between the nut and the sliding rod base.

Further, the moving device comprises connecting seats respectively fixed on each end of the guide rod, the left connecting seat of the guide rod is rotatably connected to the base, the right connecting seat of the guide rod is rotatably connected to a strap drive; the strap drive is fixed with a driven gear, the driven gear is engaged with a driving gear, and the driving gear is fixed on the rotation shaft of a first motor.

Further, the detection device comprises a photoelectric switch fixed on the base below both ends of the guide screw, and a photoelectric isolation piece fixed below the sliding rod base.

Further, the backflow preventing device comprises a sliding bush bracket and a second motor fixed on the sliding bush bracket, a transmission block is fixed on the second motor, a clamping tube fixing block is fixed on the transmission block, a sliding bush shaft is arranged to extend through the sliding bush bracket and is fixed on the clamping tube fixing block, a clamping tube cover is fixed on the other side of the sliding bush shaft; a detection device for detecting a position of clamping tube cover is provided between the clamping tube fixed block and the base.

Further, the detection device comprises a photoelectric isolation piece fixed below the clamping tube fixed block, and a photoelectric switch adapted for coordinating with the photoelectric isolation piece fixed on the base.

Further, a limiting shaft is provided below the clamping tube fixing block, the limiting shaft is fixed on the sliding bush bracket.

Further, a cover plate is fixed on the lateral seat above the flexible tube.

By adopting the above structure, a new operational principle of linear type is formed, and the structure of traditional rotary peristaltic pump is improved. Besides, the flexible tube is rarely abraded, which greatly reduces the risk of the inner wall falling off; it is easy to disassemble and assemble the flexible tube, which is advantageous for cleaning and sterilizing bacteria; the feed liquid does not contact with the device, so it is safer. The adjustment of the filling quantity is extremely simple, and it is relatively stable for packing repeatedly large quantity feed liquid; soft start can be set to avoid of splash or bubble phenomenon, and it can also realize immediate stopping and suction in order to avoid of drippage.

BRIEF DESCRIPTION OF THE DRAWINGS

The invention will be described in greater detail with references to the appended drawings in order to make the invention and the advantages understood better.

Wherein,

1. base, 2. rotation motor, 3. guide screw, 4. sliding rod base, 5. guide rod, 6. flexible tube, 7. flexible tube connector, 8. guide screw cover, 9. sliding block, 10. sliding rod base cover, 11. strap drive, 12. driven gear, 13. driving gear, 14. first motor, 15. left connecting seat of the guide rod, 16. right connecting seat of the guide rod, 17. sliding rod base shaft, 18. attachment bracket, 19. second motor, 20. sliding bush bracket, 21. limiting shaft, 22. clamping tube fixing block, 23. sliding bush shaft, 24. clamping tube cover, 25. transmission block, 26. transmission shaft, 27. bearing, 28. left lateral seat, 29. right lateral seat, 30. cover plate, 31. shaft coupling, 32. photoelectric switch, 33. photoelectric isolation piece, 301. nut, 901. rotation shaft, 902. through hole, 903. pin roller

DETAILED DESCRIPTION OF THE PREFERRED EMBODIMENTS

Figure 1:
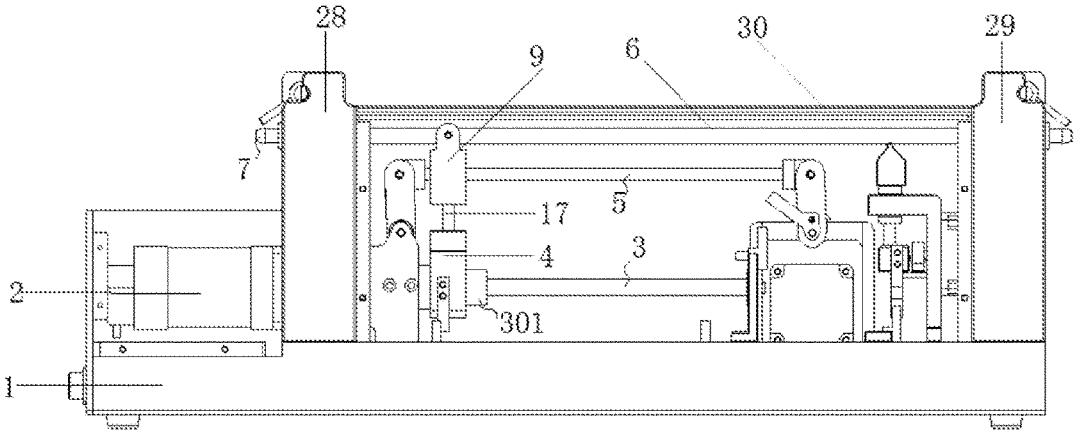
FIG. 1 is a general assembly view of the present invention.

As shown in FIG. 1, a linear peristaltic pump for precise and quantitative delivery of fluid of the present invention, comprising a base 1, a lateral seat for fixing a flexible tube 6 is provided on the base 1, the lateral seat comprises a left lateral seat 28 and a right lateral seat 29, the flexible tube 6 is fixed between the left lateral seat 28 and the right lateral seat 29. Flexible tube connectors 7 for connecting perfusion tube are provided on the both ends of the flexible tube 6. A cover plate 30 is fixed between the left lateral seat 28 and the right lateral seat 29 above the flexible tube, the cover plate 30 on one hand could well protect the flexible tube 6 from damage.

Figure 2A:
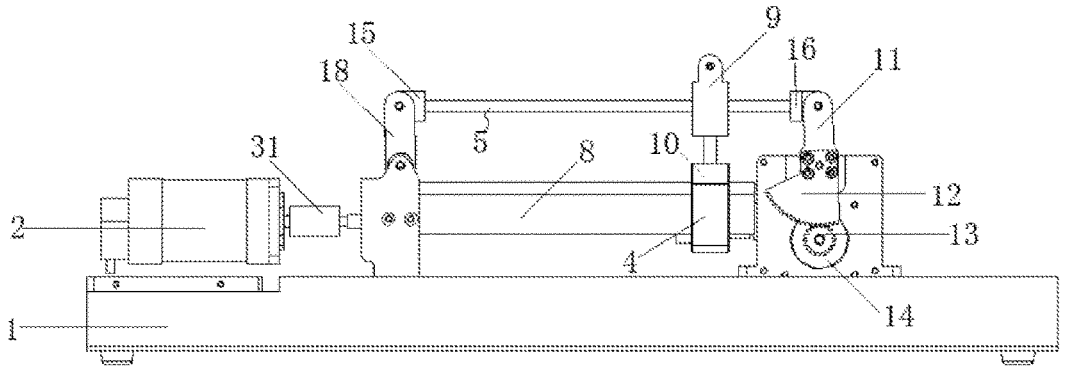
FIG. 2*a* and FIG. 2*b* are structure schematic views of linear reciprocating movement mechanism and moving device for moving sliding block up and down of the present invention.
Figure 2B:
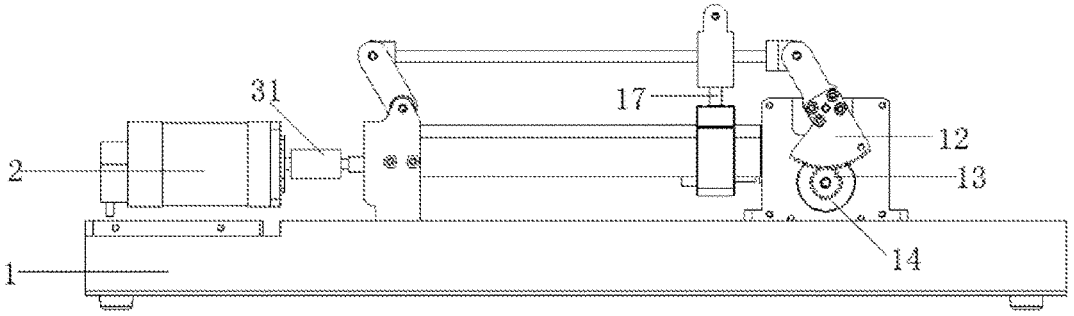

A linear reciprocating movement mechanism is provided below the flexible tube 6. As shown in FIG. 1, FIG. 2*a* and FIG. 2*b*, the linear reciprocating movement mechanism comprises a rotation motor 2 fixed on the base 1, a rotation shaft of the rotation motor 2 is in connection with a guide screw 3 through a shaft coupling 31, the guide screw 3 is provided parallel with and below the guide rod 5; the guide rod 5 is parallel with the flexible tube 6. A nut 301 adapted for moving in linear direction is provided on the guide screw 3, the nut 301 is fixed to the sliding rod base 4, the nut 301 and sliding rod base 4 can be driven by guide screw 3 to move along the guide rod 5. The rotation of the guide screw 3 is driven by the rotation motor 2, the sliding rod base 4 is adapted for coordinating with the guide screw, therefore, the sliding rod base 4 moves back and forth along the guide screw. In this way, the sliding rod base 4 can be driven by rotation motor 2 to move along the linear direction parallel with the flexible tube, therefore, the rotation angle of the guide screw can be controlled by the rotation motor 2, and the movement of the sliding rod base and the sliding block can be controlled, so that the liquid delivery quantity can be accurately and quantitatively controlled.

Figure 3:
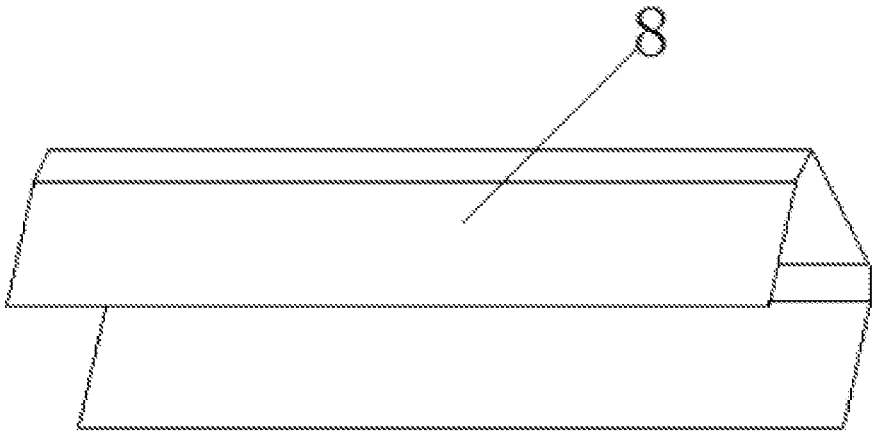
FIG. 3 is a structure schematic view of the guide screw cover of the present invention.

Further, a guide screw cover 8 is provided between the guide screw 3 and the sliding rod base 4, the structure of the guide screw cover 8 is shown in the FIG. 3. The guide screw 3 and nut 301 are disposed at the inner side of the guide screw cover 8, the sliding rod base 4 extends into the guide screw cover 8 from the both sides thereof and fixed with the nut 301 inside the guide screw cover 8. On one hand, this can effectively prevent dust from falling into the screw 3, so as to allow the screw to have a well long-term operation, on the other hand, it can guide the linear reciprocating movement of the sliding rod base 4.

Figure 4A:
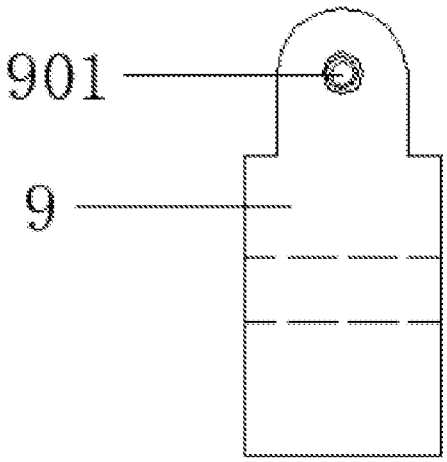
FIG. 4*a* and FIG. 4*b* are structure schematic views of sliding block of the present invention.
Figure 4B:
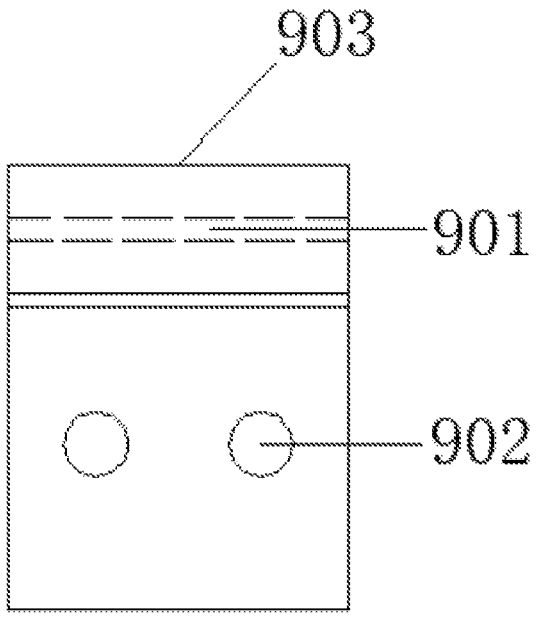

In order to squeeze the fluid in the flexible tube, a sliding rod base cover 10 is provided on the upper end of the sling rod base 4, a sliding rod base shaft 17 is fixed on the sling rod base cover 10, a sliding block 9 is sleeved on the sliding rod base shaft 17, the sliding block 9 moves up and down along the sliding rod base shaft 17. As shown in FIG. 4*a* and FIG. 4*b*, a rotatable pin roller 903 is provided at the top end of the sliding block 9, the pin roller 903 is fixed on the rotation shaft 901, the rotation shaft 901 passes through the sliding block 9 at the top thereof, in this way, the sliding block 9 can rotate around the rotation shaft 901. The pin roller 903 is in contact with the flexible tube 6, so that the state that the sliding block 9 squeezes the flexible tube 6 and releases the flexible tube 6 can be achieved by moving the sliding block up and down.

In order to achieve the reciprocating movement of the sliding block 9, a through hole 902 adapted for coordinating with the guide rod 5 is provided on the sliding block 9, there are two guide rods, which are arranged parallel with each other. The guide rod 5 is arranged to extend through the through hole 902 on the sliding block 9, and both ends of the guide rod 9 are connected with a moving device for moving the sliding block up and down.

As shown in FIG. 2*a* and FIG. 2*b*, the moving device for moving the sliding block up and down comprises connecting seats fixed on both ends of the guide rod 5, the left connecting seat of the guide rod 15 is rotatably connected to the base by an attachment bracket 18, the right connecting seat of the guide rod 16 is rotatably connected to a strap drive 11. The strap drive 11 is fixed with a driven gear 12, the driven gear 12 is engaged with a driving gear 13, and the driving gear 13 is fixed on the rotation shaft of the first motor 14. Because both ends of the guide rod 5 is in rotatable connection, when the first motor 14 rotates, the driving gear 13 drives the driven gear 12 to rotate, therefore the guide rod 5 moves downward; in this way, the sliding block 9 on the guide rod 5 moves downward, meanwhile, the sliding block 9 moves downward along the sliding rod base shaft 17, the distance between the sliding block 9 and the sliding rod base cover 10 is decreased.

In order to achieve the linear reciprocating movement, a detection device for detecting a position of sliding rod base is provided on the base, the detection device comprises a photoelectric switch 32 fixed on the base below both ends of the guide screw, and a photoelectric isolation piece 33 piece fixed below the sliding rod base 4, when the sliding rod base 4 with sliding block 9 moves to the position of both ends of the guide screw, the photoelectric switch 32 is separated by the photoelectric isolation piece 33, therefore the position of the sliding rod base 4 is detected. When the left side photoelectric switch detects the sliding rod base 4, the rotation motor 2 drives the guide screw 3 so as to drive the sliding rod base 4 to move rightward; when the right side photoelectric switch detects the sliding rod base 4, the rotation motor 2 drives the guide screw 3, so as to drive the sliding rod base 4 to moves leftward.

Figure 5A:
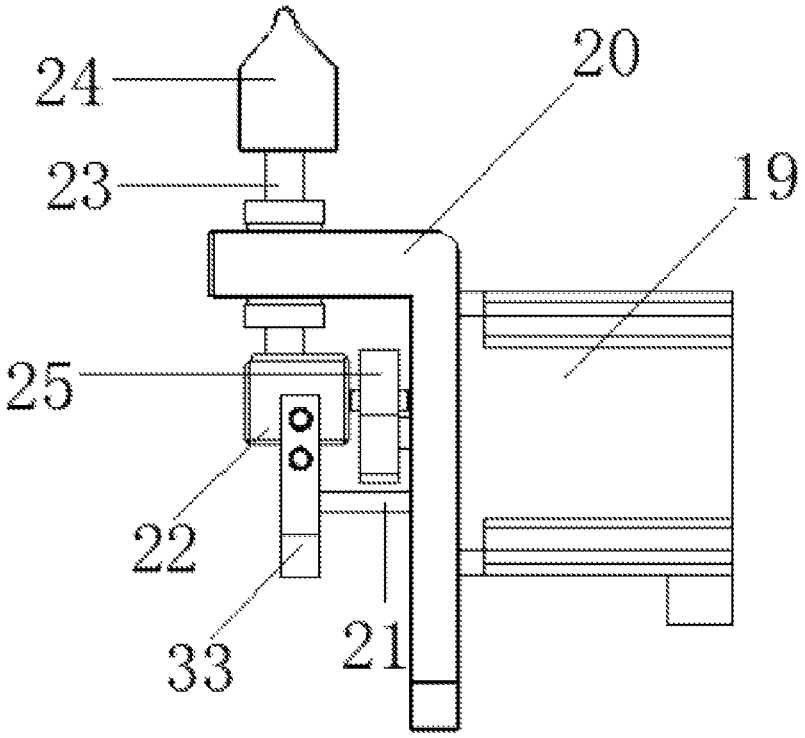
FIG. 5*a*-FIG. 5*c* are structure schematic views of back-flow preventing device of the present invention.
Figure 5B:
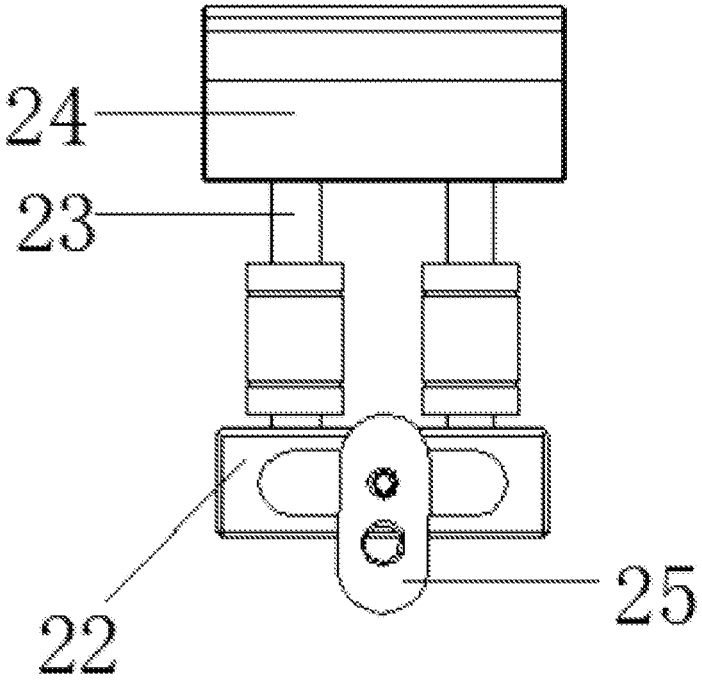
Figure 5C:
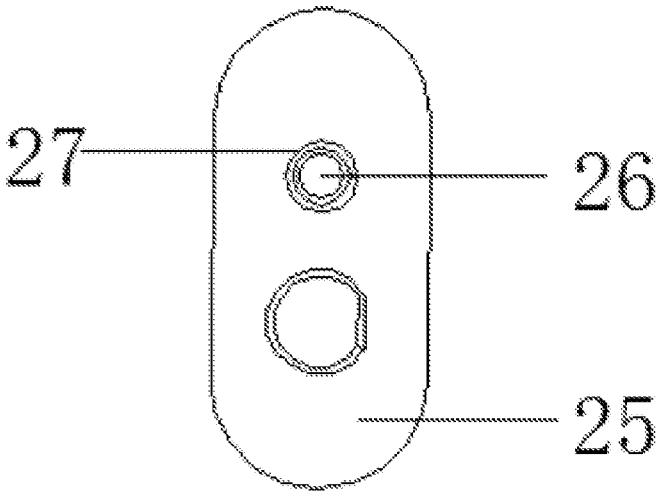

Further, in order to prevent the backflow when the rod base 4 moves leftward a backflow preventing device is fixed on the right side of the linear reciprocating movement mechanism. As shown in FIG. 5*a*-FIG. 5*c*, the backflow preventing device comprises a second motor 19 fixed on the sliding bush bracket 20, a transmission block 25 is fixed on the second motor 19, a clamping tube fixing block 22 is fixed on the transmission block 25, a sliding bush shaft 23 is arranged to extend through the sliding bush bracket 20 and is fixed on the clamping tube fixing block 22, a clamping tube cover 24 is fixed on the other side of the sliding bush shaft 23. The transmission block 25 is fixed with the second motor 19 by transmission shaft 26, a bearing 27 is provided between the transmission shaft and the transmission block 25. In this way, the transmission block 25 is driven to rotates by the second motor 19, therefore the clamping tube fixing block 22, the sliding bush shaft 23 and the clamping tube cover 24 are driven to move up and down. When the right side photoelectric switch detects the sliding rod base 4, the second motor 19 is started, so that the clamping tube cover 24 moves upward and squeezes the flexible tube 6, in this way, the fluid in the flexible tube 6 will not flow back.

Figure 6A:
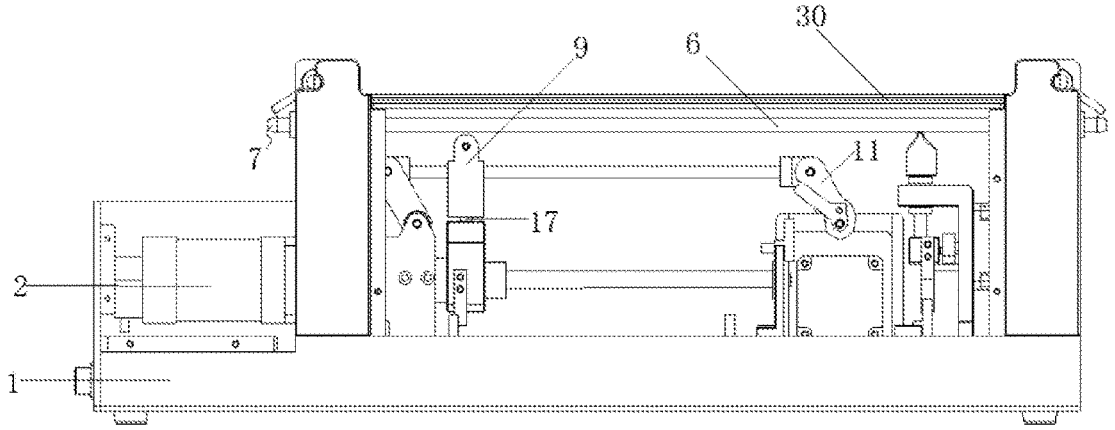
FIG. 6*a*-FIG. 6*e* are schematic views of the working process of the present invention.

In order to determine the position when the clamping tube cover moves up and down, a detection device for detecting a position of clamping tube cover is provided between the clamping tube fixed block 22 and the base 1. As shown in FIG. 5*a* and FIG. 6*a*, the detection device comprises a photoelectric isolation piece 33 fixed below the clamping tube fixed block 22, and a photoelectric switch 32 adapted for coordinating with the photoelectric isolation piece 33 fixed on the base. When the clamping tube fixing block 22, the sliding bush shaft 23 and the clamping tube cover 24 move up and down, a staggered and separated state of the photoelectric isolation piece 33 and the photoelectric switch 32 will appear, so as to realize a detection of a position of clamping tube cover.

Further, in order to prevent the clamping tube fixed block 22 from moving down too much, a limiting shaft 21 is provided below the clamping tube fixing block 22, the limiting shaft 21 is fixed on the sliding bush bracket 20.

The working process of the present invention is as follows: FIG. 6 is the star state of the present invention, the sliding rod base 4 and the sliding block 9 are disposed at the left side of the base 1, the strap drive 11 connected to the guide rod 5 is in a heeling condition, and the distance between the sliding rod base cover 10 and the sliding block 9 is short, and the sliding block 9 does not press on the flexible tube.

Figure 6B:
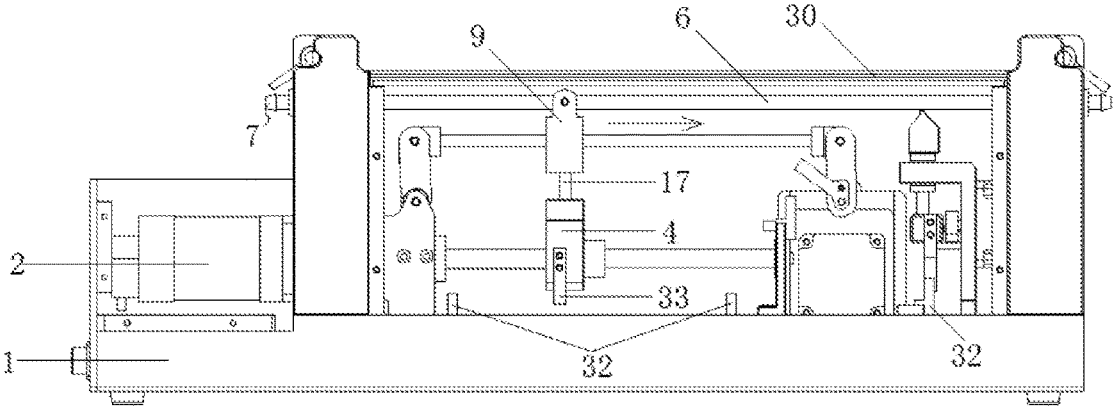

FIG. 6*b* is a schematic view showing the rotation motor 2 drives the sliding base 4 and the sliding block 9 to move right to squeeze the flexible tube. The first motor 14 of the moving device for moving the sliding block up and down is started to rotate the strap drive 11 by the cooperation of the driven gear 12 and the driving gear 13, so that the strap drive 11 is in a vertical position, therefore the sliding block 9 moves upward, the distance between the sliding rod base cover 10 and the sliding block 9 becomes longer, it can be seen from the different exposed lengths of the sliding rod base shafts 17 in FIG. 6*a* and FIG. 6*b*. the rotation of the guide screw is driven by rotation motor 2, the sliding base 4 and the sliding block 9 move rightward, the sliding block 9 squeezes the flexible tube 6, therefore the sliding block 9 squeezes the fluid in the flexible tube 6 from left to right.

Figure 6C:
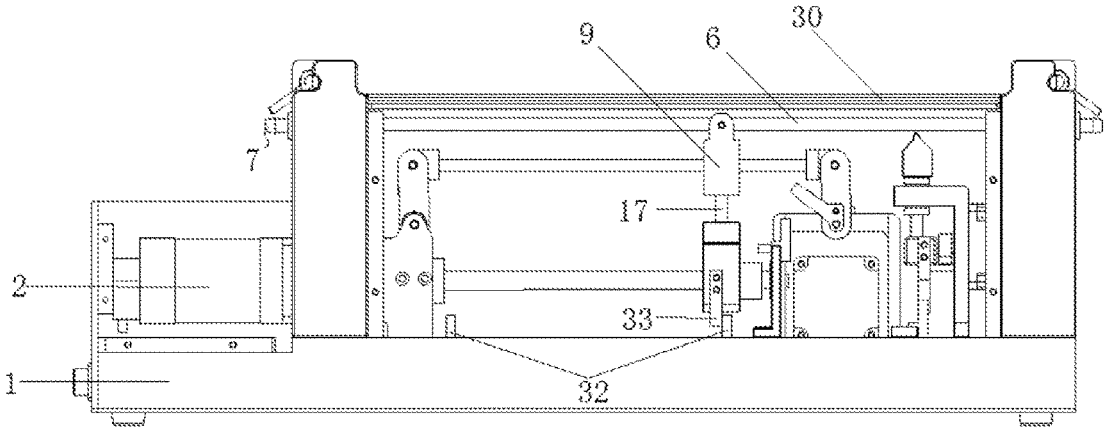

FIG. 6*c* shows that the sliding rod base 4 moves to the right end of the guide screw 3, meanwhile, the photoelectric switch 32 at the right end of the guide screw is separated by the photoelectric isolation piece 33 below the sliding rod base 4, therefore the position that the sliding rod base 4 moves to the right end of the guide screw is detected. The rotation motor 2 is controlled stop working.

Figure 6D:
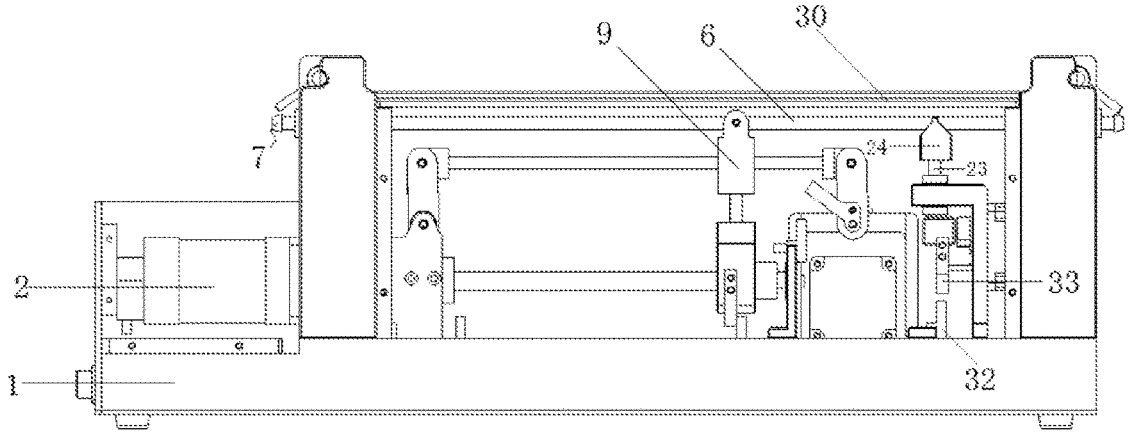

In order to prevent the fluid reflux after the fluid is squeezed, as shown in FIG. 6*d*, the second motor 19 is started, the clamping tube fixing block 22, the sliding bush shaft 23 and the clamping tube cover 24 are driven to move upward (it can be seen from the exposed length of the sliding bush shaft 23 between sliding bush bracket 20 and the clamping tube cover 24 in FIG. 6*c* and FIG. 6*d*), so as to allow the clamping tube cover 24 to squeeze the flexible tube 6 and prevent the fluid from refluxing.

Figure 6E:
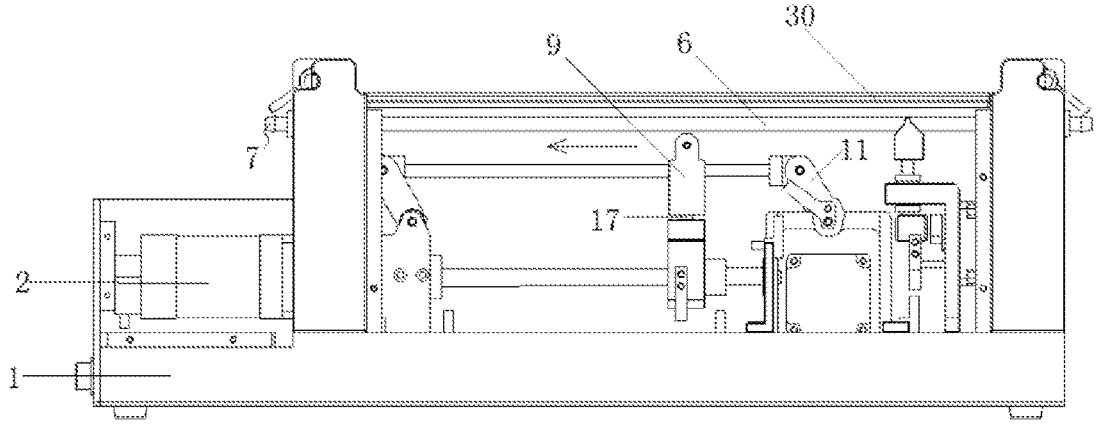

Finally, as shown in FIG. 6*e*, the first motor 14 is started, and the driving gear 13 drives the driven gear 12 to rotate, therefore the guide rod 5 moves downward, and the sliding block 9 on the guide rod 5 moves downward, meanwhile, the sliding block 9 moves downward along the sliding rod base shaft 17. In this way, the sliding block 9 is separated from the flexible tube 6 then the rotation motor 2 drives the guide screw in reverse direction, so as to drive the sliding rod base 4 and sliding block 9 to move leftward. When moving to the left end, the photoelectric switch 32 at the left end of the guide screw is separated by the photoelectric isolation piece 33 below the sliding rod base 4, therefore the position that the sliding rod base 4 moves to the left end of the guide screw is detected. At this time, the second motor 19 is started, the clamping tube fixing block 22, the sliding bush shaft 23 and the clamping tube cover 24 are driven to move downward, and the apparatus then returns to the state shown in FIG. 6*a*.

The description above refers to a reciprocating squeezing of fluid in the flexible tube, according to the FIG. 6*a*-FIG. 6*e*, a continuously reciprocating squeezing of fluid in the flexible tube can be achieved.

Of course, the linear reciprocating movement mechanism in the present invention can also adopt a screw thread pair or a combined rack and gear, the detection device for detecting a position of sliding rod base can also adopt a shutter and an over travel-limit switch, such modifications could be derived without departing from the scope of the invention.

It needs to declare that, the above mentioned summery of the invention and the embodiments are intended to provide a practical application of the technical solution of the present invention, which do not constitute limitation of the present invention. It is obviously to the skilled person in the art that, various modifications could be derived without departing from the spirits and the effects of the invention. Therefore, the protection scope of the present invention is subject to the claims.

The invention claimed is:

1. A linear peristaltic pump for precise and quantitative delivery of fluid, comprising a base, wherein, a lateral seat for fixing a flexible tube is provided on the base, a linear reciprocating movement mechanism is provided below said flexible tube;

a sliding rod base is provided on said linear reciprocating movement mechanism, a sliding rod base shaft is fixed on said sliding rod base, a sliding block is sleeved on said sliding rod base shaft;

a pin roller is provided at a top end of said sliding block, adapted for squeezing the flexible tube to allow fluid in said tube to move forward, said pin roller is in contact with said flexible tube;

a first detection device for detecting a position of the sliding rod base is provided on said base;

a guide rod parallel with said flexible tube is fixed on said lateral seat, a through hole adapted for coordinating with said guide rod is provided on said sliding block, said guide rod is arranged to extend through the through hole on the sliding block, and both ends of said guide rod are connected with a moving device for moving said sliding block up and down;

a backflow preventing device is fixed on the base arranged adjacent to said linear reciprocating movement mechanism.

2. The linear peristaltic pump for precise and quantitative delivering of fluid of claim 1, wherein, said linear reciprocating movement mechanism comprises a rotation motor fixed on said base;

a rotation shaft of said rotation motor is in transmission connection with a guide screw through a shaft coupling, said guide screw is provided parallel with and below said guide rod;

a nut adapted for moving in a linear direction is provided on said guide screw, said nut is fixed to said sliding rod base.

3. The linear peristaltic pump for precise and quantitative delivery of fluid of claim 2, wherein, a guide screw cover is provided between said nut and said sliding rod base.

4. The linear peristaltic pump for precise and quantitative delivery of fluid of claim 1, wherein, said moving device comprises a first motor, a first connecting seat of said guide rod fixed on a first end of said guide rod and a second connecting seat of said guide rod fixed on a second end of said guide rod, said first connecting seat of said guide rod is rotatably connected to said base, said second connecting seat of said guide rod is rotatably connected to a strap drive;

said strap drive is fixed with a driven gear, said driven gear is engaged with a driving gear, and said driving gear is fixed on a rotation shaft of said first motor.

5. The linear peristaltic pump for precise and quantitative delivering of fluid of claim 2, wherein, said first detection device comprises a photoelectric switch fixed on the base below both ends of said guide screw, and a photoelectric isolation piece fixed below said sliding rod base.

6. The linear peristaltic pump for precise and quantitative delivering of fluid of claim 1, wherein, said backflow preventing device comprises a sliding bush bracket and a second motor fixed on said sliding bush bracket, a transmission block is fixed on said second motor, a clamping tube fixing block is fixed on said transmission block, a sliding bush shaft is arranged to extend through the sliding bush bracket and is fixed on said clamping tube fixing block, a clamping tube cover is fixed on an end of said sliding bush shaft away from the clamping tube fixing block;

a second detection device for detecting a position of clamping tube cover is provided between said clamping tube fixing block and said base.

7. The linear peristaltic pump for precise and quantitative delivering of fluid of claim 6, wherein, said second detection device comprises a photoelectric isolation piece fixed below said clamping tube fixing block, and a photoelectric switch adapted for coordinating with the photoelectric isolation piece fixed on the base.

8. The linear peristaltic pump for precise and quantitative delivering of fluid of claim 6, wherein, a limiting shaft is provided below said clamping tube fixing block, said limiting shaft is fixed on said sliding bush bracket.

9. The linear peristaltic pump for precise and quantitative delivering of fluid of claim 1, wherein, a cover plate is fixed on said lateral seat above said flexible tube.

* * * * *